United States Patent [19]

Woron

[11] 4,212,221

[45] Jul. 15, 1980

[54] METHOD AND APPARATUS FOR NOTE ATTACK AND DECAY IN AN ELECTRONIC MUSICAL INSTRUMENT

[75] Inventor: Robert P. Woron, Allentown, Pa.

[73] Assignee: Allen Organ Company, Macungie, Pa.

[21] Appl. No.: 891,874

[22] Filed: Mar. 30, 1978

Related U.S. Application Data

[63] Continuation-in-part of Ser. No. 787,695, Apr. 14, 1977, abandoned.

[51] Int. Cl.[2] ..... G10H 1/02; G10H 5/00

[52] U.S. Cl. ..... 84/1.26; 84/1.13

[58] Field of Search ..... 84/1.13, 1.26

[56] References Cited

U.S. PATENT DOCUMENTS

| | | | |
|---|---|---|---|
| 3,610,805 | 10/1971 | Watson et al. | 84/1.13 |
| 3,819,844 | 6/1974 | Isii | 84/1.26 |
| 4,014,238 | 3/1977 | Southard | 84/1.13 |
| 4,026,179 | 5/1977 | Futamase | 84/1.26 X |
| 4,033,219 | 7/1977 | Deutsch | 84/1.13 X |
| 4,079,650 | 3/1978 | Deutsch et al. | 84/1.26 |
| 4,108,036 | 8/1978 | Slaymaker | 84/1.26 X |
| 4,114,495 | 9/1978 | Tomisawa | 84/1.26 X |
| 4,119,006 | 10/1978 | Whitefield | 84/1.13 |
| 4,128,032 | 12/1978 | Wada et al. | 84/1.26 X |
| 4,144,787 | 3/1979 | Robinson et al. | 84/1.26 X |

*Primary Examiner*—S. J. Witkowski

*Attorney, Agent, or Firm*—Seidel, Gonda, Goldhammer & Panitch

[57] ABSTRACT

The present invention is a two-part apparatus for producing note attack and decay in a conventional electronic musical instrument. Either part of the invention may be used independently of the other; however, at present the combined use is preferred. In part one, there is provided an eight state counter clocked at a rate equal to the note generator cycle and a digital magnitude comparator. The inputs (A) from the eight state counter are compared to the attack and decay scale factor inputs (B) by the comparator. The A>B,A=B functions are generated by the comparator in combination with an OR gate. The OR gate output and the sample gating signal from the conventional musical instrument are applied to an AND gate which outputs a modulated sample gating signal. In part two, the modulated sample gating signal of part one is subpulsed individually by two subpulses. Through the use of gating techniques, the most significant bit of the attack and decay scale factor is used to combine the modulated sample gating signal with the first of the two subpulses. Upon reaching the maximum pulse frequency with the first subpulse, the most significant bit of the attack and decay scale factor forces the continued maximum frequency output of the first subpulse and begins a second combination using the second of the two subpulses. The second output is combined with the first through OR gating which results in a signal with both sample period and pulse width modulation.

5 Claims, 5 Drawing Figures

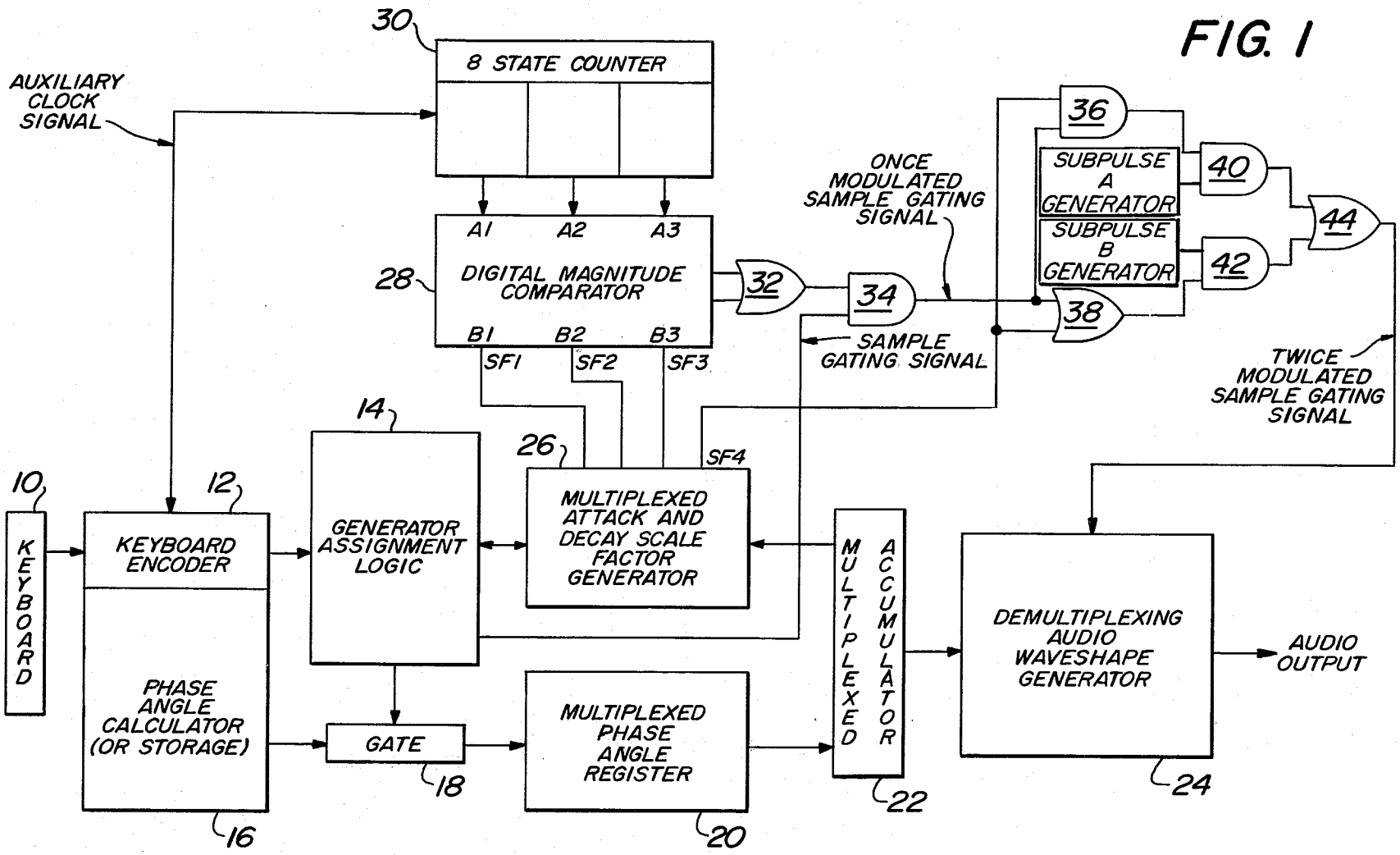
FIG. 1
KEYBOARD
10
KEYBOARD ENCODER
12
PHASE ANGLE CALCULATOR (OR STORAGE)
16
AUXILIARY CLOCK SIGNAL
GENERATOR ASSIGNMENT LOGIC
14
GATE
18
MULTIPLEXED PHASE ANGLE REGISTER
20
MULTIPLEXED ATTACK AND DECAY SCALE FACTOR GENERATOR
26
SF4
MULTIPLEXED ACCUMULATOR
22
DEMULTIPLEXING AUDIO WAVESHAPE GENERATOR
24
AUDIO OUTPUT
8 STATE COUNTER
30
DIGITAL MAGNITUDE COMPARATOR
28
A1
A2
A3
B1
B2
B3
SF1
SF2
SF3
32
34
SAMPLE GATING SIGNAL
ONCE MODULATED SAMPLE GATING SIGNAL
36
38
SUBPULSE A GENERATOR
SUBPULSE B GENERATOR
40
42
44
TWICE MODULATED SAMPLE GATING SIGNAL

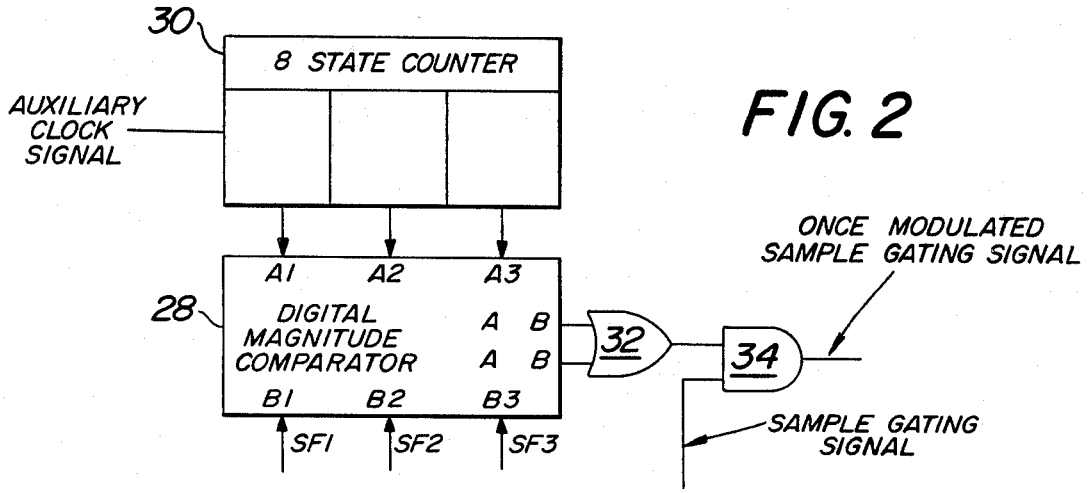
FIG. 2
FIG. 3
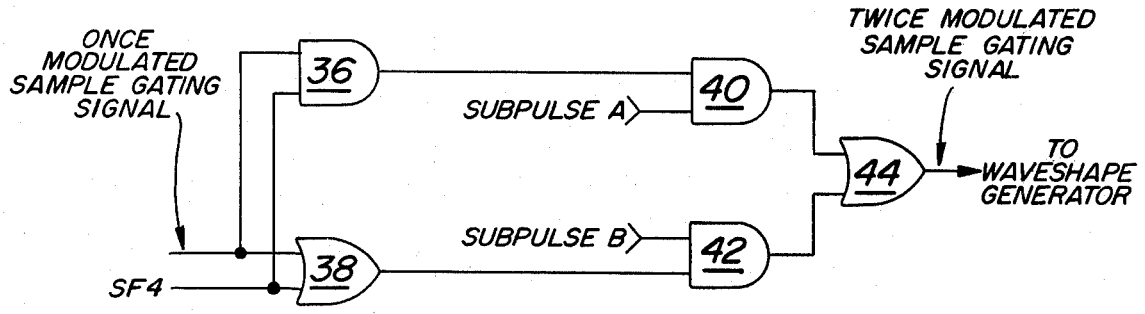
FIG. 4
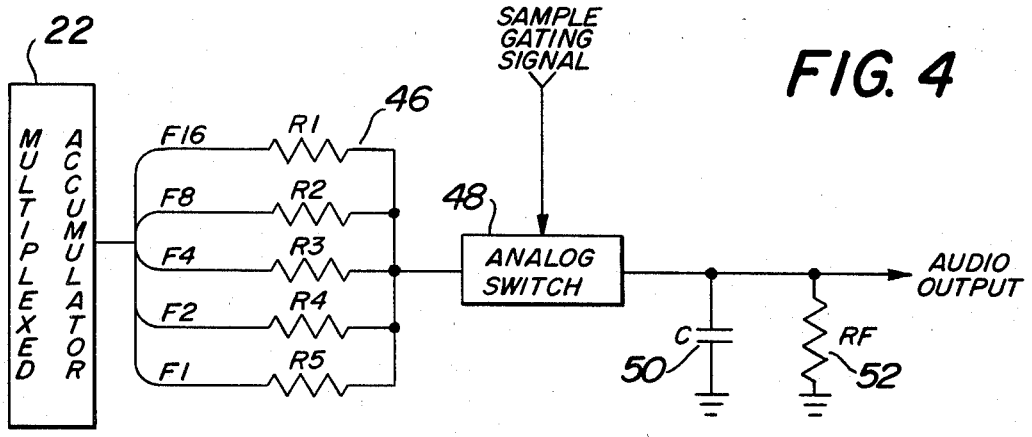

| SF1 | SF2 | SF3 | SF4 | SCALE FACTOR | 8 CYCLES OF TONE GENERATOR MULTIPLEX CYCLE 96 SEC. TYPICAL | | | | | | | |
|---|---|---|---|---|---|---|---|---|---|---|---|---|
| | | | | | 0 | 1 | 2 | 3 | 4 | 5 | 6 | 7 |
| 0 | 0 | 0 | 0 | 1 | b | 0 | 0 | 0 | 0 | 0 | 0 | 0 |
| 1 | 0 | 0 | 0 | 2 | b | b | 0 | 0 | 0 | 0 | 0 | 0 |
| 0 | 1 | 0 | 0 | 3 | b | b | b | 0 | 0 | 0 | 0 | 0 |
| 1 | 1 | 0 | 0 | 4 | b | b | b | b | 0 | 0 | 0 | 0 |
| 0 | 0 | 1 | 0 | 5 | b | b | b | b | b | 0 | 0 | 0 |
| 1 | 0 | 1 | 0 | 6 | b | b | b | b | b | b | 0 | 0 |
| 0 | 1 | 1 | 0 | 7 | b | b | b | b | b | b | b | 0 |
| 1 | 1 | 1 | 0 | 8 | b | b | b | b | b | b | b | 0 |
| 0 | 0 | 0 | 1 | 9 | a +b | b | b | b | b | b | b | b |
| 1 | 0 | 0 | 1 | 10 | a +b | a +b | b | b | b | b | b | b |
| 0 | 1 | 0 | 1 | 11 | a +b | a +b | a +b | b | b | b | b | b |
| 1 | 1 | 0 | 1 | 12 | a +b | a +b | a +b | a +b | b | b | b | b |
| 0 | 0 | 1 | 1 | 13 | a +b | a +b | a +b | a +b | a +b | b | b | b |
| 1 | 0 | 1 | 1 | 14 | a +b | a +b | a +b | a +b | a +b | a +b | b | b |
| 0 | 1 | 1 | 1 | 15 | a +b | a +b | a +b | a +b | a +b | a +b | a +b | b |
| 1 | 1 | 1 | 1 | 16 | a +b | a +b | a +b | a +b | a +b | a +b | a +b | a +b |

RELATIVE WIDTH AND FREQUENCY OF THE SAMPLING GATE

FIG. 5

METHOD AND APPARATUS FOR NOTE ATTACK AND DECAY IN AN ELECTRONIC MUSICAL INSTRUMENT

RELATED CASE

This is a continuation-in-part application based on U.S. application Ser. No. 787,695 filed Apr. 14, 1977 for "Method And Apparatus For Note Attack And Decay In An Electronic Musical Instrument" by Robert P. Woron assigned to the assignee herein and now abandoned.

BACKGROUND OF THE INVENTION

This invention resides broadly in the field of electronic musical instruments, and is particularly adaptable for use in instruments employing a demultiplexing audio waveshape generator.

The principles of the present invention are applicable to various electronic musical instruments in which musical sounds are generated in response to actuation of key switches regardless of whether those switches are actuated directly, e.g., by the musician's fingers, or indirectly, e.g., by the plucking of strings. The term key is used in a generic sense, to include depressible levers, actuable on-off switches, touch or proximity responsive devices, closable apertures and so forth. The present invention relates to the attack and decay characteristics of a musical note placed on an electronic musical instrument. More particularly, the present invention relates to a two-part attack and decay system, either part of which may also be used independently of the other for an electronic musical instrument.

The function of an electronic musical instrument is to reproduce or simulate the notes of a musical scale by electronic means. In order to provide other than an abrupt start with an abrupt end of the tone envelope generated when a particular key is depressed and released, respectively, it is desirable to simulate tone attack and decay by gradually increasing the tone amplitude at the leading edge and gradually decreasing the amplitude at the trailing edge.

Heretofore, the systems used either analog or digital envelope signals which were applied to a scaler for controlling the relative note amplitudes from zero to maximum value. Typically in an analog instrument, this scaling was accomplished through an amplitude control such as keyers or a voltage controlled amplifier and in a digital instrument the scaling was typically accomplished using a digital multiplier. Such prior art attack and decay systems were complicated and required extensive hardware. The present invention provides the advantages of being simple and cost effective.

SUMMARY OF THE INVENTION

The present invention provides a new and unobvious two-part attack and decay system which is particularly useful in electronic musical instruments. The present invention provides a significant advantage in that an instrument may use the parts of the invention together or either part separately, depending on the tonal design of the subject instrument.

Briefly, in accordance with the present invention, there is provided a two-part apparatus for producing note attack and decay in an electronic musical instrument. In part one, an eight state counter is clocked at a rate equal to the frequency of the note generator cycle. Thus, each channel of the note generator cycle will see each state of the eight state counter before that state changes. The individual outputs of the eight state counter feed into their respective "A" inputs of the digital magnitude comparator. The note attack and decay scale factors feed into the "B" inputs of the digital magnitude comparator. The comparator compares the "A" inputs to the "B" inputs. The A>B and the A=B outputs of the digital magnitude comparator are applied to the inputs of an OR gate. As the attack and decay scale factor increases from zero to maximum value in a particular channel, the high output of the OR gate will occur infrequently at first and gradually build to maximum frequency. The output of the OR gate is applied to one input of an AND gate. The sample gating signal is applied to the other input of the AND gate. The resulting output of the AND gate is a modulated sample gating signal which modulates the audio output amplitude in proportion to the sample period modulation of the sample gating signal. The disclosure to this point has been concerned with part one of the invention. Part one, while functional alone, may not produce the desired tonal quality in a particular use. Therefore, an additional apparatus herein called part two is disclosed. Part two, while functional alone in an analog instrument, is most useful as a refinement means when used in conjunction with part one.

Part two of the apparatus relies upon sample pulse width modulation. It can therefore be seen that part one modulates the sample period and part two modulates the width of the sample pulse. The period modulated sample gating signal of part one is modulated individually by two subpulses through gating techniques. The most significant bit of the attack and decay scale factor is used to control the combining of the modulated sample gating signal and the individual subpulses. Under control of the most significant bit information, the part one modulated sample gating signal is continuously subpulsed by the first of the two subpulses until the maximum frequency of occurrence is obtained. Upon reaching this point, the most significant bit changes and the first subpulsed signal is maintained at maximum frequency of occurrence. Simultaneously therewith, the most significant bit change initiates the combining of the sample gating signal of part one and the second of the two subpulses until maximum frequency of occurrence is obtained with this subpulse. The subpulsed sample gating signal is the original sample gating signal twice modulated as to pulse width and frequency of occurrence and is applied to the audio waveshape generator.

BRIEF DESCRIPTION OF THE DRAWINGS

For the purpose of illustrating the invention, there are shown in the drawings forms which are presently preferred; it being understood, however, that the invention is not limited to the precise arrangements and instrumentalities shown.

FIG. 1 is a schematic diagram partly in block form, of an electronic musical instrument embodying a two-part attack and decay apparatus in accordance with the present invention.

FIG. 2 is a schematic diagram, partly in block form, of part one of the present invention.

FIG. 3 is a schematic diagram of part two of the present invention.

FIG. 4 is a schematic diagram, partly in block form, of an audio waveshape generator which is particularly suited for use with the present invention.

FIG. 5 is a graphic representation of the relationship between the scale factors and the two modulation schemes as used in the preferred embodiment.

DESCRIPTION OF THE PREFERRED EMBODIMENT

The present invention as described herein is a two-part apparatus; as the combination is presently viewed as the best mode of operation. However, it is understood that either part may be used separately as an attack and decay apparatus in an electronic musical instrument. Additionally, the preferred embodiment is described as used in conjunction with a demultiplexing audio waveshape generator. In the copending application Ser. No. 787,696 of Rober P. Woron entitled "Demultiplexing Audio Waveshape Generator", filed on Apr. 14, 1977, now U.S. Pat. No. 4,134,321, and assigned to the same assignee as the present invention, there is described a demultiplexing audio waveshape generator particularly suited for use with the present invention. Electronic musical instruments or digital electronic musical instruments in which the present invention may be applied and used are described in detail in U.S. Pat. Nos. 3,610,799 and 3,639,913, of which the inventor was George A. Watson; and U.S. Pat. No. 3,610,805, of which the inventors were Ralph Deutsch and George A. Watson. Reference may be had to these patents for demultiplexing audio waveshape generators and detailed descriptions of components referred to herein other than the apparatus for attack and decay producing structural relationships in accordance with the invention.

In FIG. 1, there is shown a conventional digital electronic musical instrument connected to both parts of the invention herein. In the conventional instrument, a keyboard 10 is composed of a plurality of key switches or keys. The key switches or keys are used in the generic sense and will be referred to herein as keys, being the keys of various electronic musical instruments. The activity of a key on keyboard 10 is encoded in a time-division multiplexed format by keyboard encoder 12. The multiplexed signal encoded by keyboard encoder 12 is presented to generator assignment logic 14.

The function of generator assignment logic 14 is to capture a multiplexed channel of the demultiplexing audio waveshape generator 24 in behalf of the active key as indicated by the multiplexed encoding signal from keyboard encoder 12. The time division relationship between the multiplexed keyboard signal of encoder 12 and the multiplexed channels of demultiplexing audio waveshape generator 24 is such that each individual key of keyboard 10 is allocated a time slot typically of 12$\mu$ seconds and the demultiplexing audio waveshape generator (note generator) typically has 12 multiplexed channels per each 12$\mu$ second time slot, each note generator multiplexed channel being allocated a time slot of 1$\mu$ second. Therefore, the 12$\mu$ second time slot period of any key defines one note generator cycle of 12 individual multiplexed channels available for capture. The generator assignment logic 14 will capture certain of the note generator multiplexed channels when one or more keys are activated. Capture of these note generator channels will take place each note generator cycle until the respective key or keys are deactivated whereupon the generator assignment logic 14 will free the associated channel so that the channel again becomes available for capture. The above brief description of generator assignment logic 14 is more fully explained in U.S. Pat. No. 3,610,799.

Referring again to the portion of FIG. 1 showing the conventional instrument, phase angle calculator 16 calculates phase angle numbers in synchronism with the multiplexed keyboard pulse time slots. The calculation of the phase angle may be done as a function of the frequency of the note to be reproduced. An alternative to calculating the phase angle is a conventional memory with look-up capabilities or simply a memory from which the correct phase angle is extracted when suitably addressed. A combination of a memory with look-up capabilities and of a calculator capable of computing the phase angle may be employed. The phase angle generated, regardless of how generated, is gated through gate 18 in response to the gate enabling signal from generator assignment logic 14. The enabling signal from assignment logic 14 coordinates the loading of the appropriate phase angle numbers into multiplexed phase angle register 20 at the 1$\mu$ second time slot position corresponding to the demultiplexing audio waveshape generator channel as described above.

The multiplexing phase angle register 20 has a capacity to hold a phase angle number for each individual channel of the waveshape generator. Each number stored in the multiplexed phase angle register 20 is added to its respective channel in the multiplexed accumulator 22 every note generator cycle, that is, every 12$\mu$ seconds. The individual totals in the accumulator channels increase in magnitude at a rate proportional to their respective phase angle numbers. The values of the phase angle numbers are chosen such that a preselected bit position of the multiplexed accumulator 20 will toggle at the desired F8 or eight foot musical frequency corresponding to the key assigned that waveshape generator channel by the general assignment logic 14.

The attack and decay scale factors are produced by attack and decay scale factor generator 26 of FIG. 1. Scale factor generator means are well known in the art; a description of one such means may be found in U.S. Pat. No. 3,610,805. Each scale factor represents the value by which the audio waveshape for a multiplexed note generator channel must be scaled to attain the desired attack and decay envelope. The rate at which the attack and decay scale factor generator 26 generates the scale factors is controlled by the multiplexed accumulator 22. Upon completion of a decay envelope, the attack and decay scale factor generator causes the generator assignment logic 14 to free the captured channel.

The components described thus far are well known conventional elements of subsisting electronic musical instruments known in the art. The present invention is directed to the eight state counter 30, comparator 28 and associated logic circuitry for generating the twice modulated sample gating signal in FIG. 1.

Referring to FIG. 2, the eight state counter 30 is advanced by the auxiliary clock signal at a count rate euqal to or approximately equal to the multiplex cycle rate of the audio waveshape generator. The counter 30 may be a 3-stage binary counter. In the electronic musical instrument shown in FIG. 1, the clock rate would be equal to the multiplex cycle rate of the audio waveshape generator (typically 12$\mu$ seconds in duration). In the preferred embodiment, the counter 30 holds a state until compared with each channel scale factor and presents all eight states before repeating a state. This preferred timing allows each multiplexed channel of the note generator to see a particular state of the eight state counter 30 before that state changes. Referring again to FIG. 2, the eight states of the counter 30 are compared to the attack and decay scale factors by digital magnitude comparator 28. Each bit of the eight state counter 30 is applied independently to the respective inputs A1, A2, A3 of the digital magnitude comparator 28. The scale factors SF1, SF2, SF3 from the attack and decay scale factor generator 26 of FIG. 1 are applied independently to the respective inputs B1, B2, B3 of the digital magnitude comparator 28. Digital magnitude comparator 28 is a readily available standard component, e.g., Motorola part number MC14585CP. As a function of comparator 28, the magnitude of the A inputs from the counter 30 are compared to the magnitude of the B inputs from the scale factor generator 26 of FIG. 1. The A>B and A=B outputs of the digital magnitude comparator are applied to OR gate 32. Therefore, as the attack and decay scale factor, inputs B, increase from zero to maximum in a particular channel, the high output of OR gate 32 will occur infrequently at first and gradually build to maximum frequency or once every note generatormultiplex cycle. When the scale factor is zero, the A>B output of the digital magnitude comparator 28 is always low because the output of the counter 30 is never less than zero. However, the A=B output of the digital magnitude comparator 28 will be high every time the counter 30 output equals zero. For the embodiment shown, this occurs evey eighth cycle of the note generator multiplex pattern. The high output of the OR gate 32 will occur infrequently in this situation. When the scale factor increases to a magnitude of one, the A>B output of the digital magnitude comparator 28 will be high only when the output of the counter 30 is zero. The A=B output will be high only when the counter 30 output has a magnitude of one. This means that the output of the OR gate 32 will be high for two out of every eight cycles of the note generator multiplex pattern, more frequently than before. Similarly, when the scale factor increases to a magnitude of two, the A>B output of the digital magnitude comparator 28 will be high when the output of the counter 30 is either zero or one, while the A=B output of the digital magnitude comparator 28 will be high when the counter 30 output equals two. Thus the output of the OR gate 32 will be high for three out of eight cycles of the note generator multiplex pattern, again more frequently than the previous case. This process continues with the output of the OR gate 32 increasing in frequency until an output occurs for every cycle of the note generator multiplex pattern. Each channel of the note generator multiplex pattern functions in this manner independent of the other channels.

The output of the OR gate 32 is connected to one input of an AND gate 34. The other input of the AND gate 34 is the sample gating signal from FIG. 1. The sample gating signal is generated by generator assignment logic 14 to indicate that a note generator channel has been captured by an active key as described in U.S. Pat. No. 3,610,799. The net effect is that the sample gating signal, which defines whether or not a particular note generator channel is supposed to be sounding or not, is modulated by the output of the OR gate 32 which in turn is controlled by the attack and decay scale factors from 26 of FIG. 1. If the modulated sample gating signal from AND gate 34, hereinafter referred to as the once modulated sample gating signal, is connected to the demultiplexing audio waveshape generator of FIG. 4, described more particularly in U.S. Pat. No. 4,134,321, the amplitude of the audio output on a channel by channel basis will be amplitude modulated in proportion to the frequency or infrequency of the modulated sample gating signal. This occurs because the amplitude of the audio output is a function of how frequently capacitor C50 of FIG. 4 is charged incrementally as the audio waveshape is being constructed. Fewer increments of charge per unit time will result in an audio waveshape of lesser amplitude.

Referring more particularly to FIG. 4, the time-division multiplexed frequency signals produced by the accumulator 22 are presented such that the F8 or eight foot musical frequency bit of each note generator channel is presented to the same resistor input lead R2 in time-division multiplexed fashion. The F16 or sixteen foot musical frequency bit of each channel is presented to the same resistor input lead R1 and so on until each selected musical frequency bit has been presented to a resistor. Typically, every 1$\mu$ second a channel containing multiplexed musical frequency information will be presented to the audio generator input, thus, assuming a twelve channel system, a complete demultiplexing audio waveshape generator cycle will typically repeat every 12$\mu$ seconds. The multiplexed signals at the accumulator output drive current through the respective weighting resistors 46 whereby a contribution proportional to the value of the resistor and the instantaneous driving voltage is made to the current flow through analog switch 48. Analog switch 48 is a readily available standard component, e.g., RCA part CD 4016A E.

The function of analog switch 48 is to select the demultiplexing audio waveshape generator channels which are to be combined to form the audio waveshape output. The selection of the required channels is made in response to the modulated sample gating signal from AND gate 34. Upon command of the modulated sample gating signal analog switch 48 is closed. A current, which is proportional to the weighting resistors 46 and the state of the respective frequency signals produced by accumulator 22, drives the resistors and flows into the capacitor-resistor combination 50 and 52 resulting in a voltage increment on the capacitor 50 corresponding to the desired contribution of that note generator channel to the audio waveshape at that particular instant in time. If more than one channel is selected in response to the modulated sample gating signal, each selected channel will contribute its own voltage increments to the composite audio waveshape output.

Capacitor-resistor combination 50 and 52 also forms a lowpass filter with respect to the audio tone. The characteristics of this filter may be selected using standard procedures to obtain the desired final audio output tone.

For the benefit of clarity, the foregoing disclosure has dealt only with the attack period. During the decay period, the functional principle remains the same; however, since the scale factor at the beginning of the decay period is at maximum value, the reverse process will occur. The output of OR gate 32 decreases in frequency from an output for every cycle of the note generator multiplex pattern to minimum output, thereby producing note decay.

The above-described apparatus constitutes part one of the present invention and may be used as described for note attack and decay in an electronic musical instrument. The principle of controlling how frequently capacitor C50 of FIG. 4 is incremented can be applied to a limited degree without adversely affecting the integrity of the waveshape during attack and decay. Some coloring of the tone can be tolerated during attack and decay since these are transient periods in the duration of the tone. In a note generator multiplex cycle typically of 12μ seconds duration, it has been found that as many as seven out of eight cycles of the tone generator multiplex pattern can be dropped during attack and decay without adverse consequences. Thus the apparatus described will provide eight discrete levels of amplitude during attack and decay. Additionally, it has been determined that eight discrete amplitude levels may not provide a sufficiently "smooth" attack and decay for some applications. If it is determined that a "smoother" attack and decay is required in a particular application, part two of the invention hereinafter described may be used to further "smooth" the attack and decay.

Part two of the attack and decay system employs sample pulse width modulation in contradistinction to the sample period modulation of part one. This portion of the system is shown in FIG. 3. The principle of operation recognizes the fact that the amount of charge transferred to capacitor C50 of FIG. 4 depends on the width of the sample gating signal. Thus by modulating the width of the sample gating signal, the amplitude of the audio waveshape can be modulated. In the logical diagram of FIG. 3, the once modulated sample gating signal from part one of the attack and decay system is modulated by two non-overlapping subpulse trains A and B of equal pulse width and repetition frequency. Subpulse A and subpulse B occur once every waveshape generator multiplex channel timeslot. The combined duration of supulse A and subpulse B is less than or equal to the duration of the waveshape generator multiplex channel time slot (1μ second for the embodiment described herein). Modulation is controlled by SF4, the most significant bit of the attack and decay scale factor, from multiplexed attack and decay scale factor generator 26 of FIG. 1. The once modulated sample gating signal from AND gate 34 of FIG. 2 is applied to one input of AND gate 36 and OR gate 38 of FIG. 3. Thus when SF4 is zero, AND gates 36 and 40 are inactivated, but OR gate 38 is activated. The result is that the once modulated sample gating signal from part one is allowed to pass through OR gate 38 and is applied to AND gate 42. Thus the once modulated sample gating signal from part one is further modulated by subpulse B of relative width "b". As the scale factor increases, the frequency of occurrence of the twice modulated sample gating signal increases due to the action of part one of the invention until the maximum scale factor is reached. In order to increase the average on time beyond this point, the width of the twice modulated sample gating signal must be increased. This is accomplished when SF4 switches to a logic one in which case OR gate 38 is forced on, which in turn activates AND gate 42 on a continuous basis, independent of the once modulated sample gating signal, thereby obtaining the continued maximum contribution of subpulse B, of relative width "b". Additionally, when SF4 switches to a logic one, AND gate 36 is activated allowing the once modulated sample gating signal from part one to pass through AND gate 36 and on to an input of AND gate 40 where it is modulated by subpulse A of relative width "a", as described above for subpulse B. The subpulsed signal from AND gate 40 is combined with the subpulsed signal from AND gate 42 in OR gate 44. The output of OR gate 44 is the twice modulated sample gating signal which is applied to the demultiplexing audio waveshape generator 24 of FIG. 4 as described hereinabove.

Reference may be had to FIG. 5 for a graphic representation of the above-described conditions. The chart of FIG. 5 shows the relationship between the scale factors and the two modulation schemes. For scale factors 1–8, SF4, the most significant bit, is a logic zero. Therefore, for these cases, subpulse B of relative width "b" is used. As the scale factor increases from 1 to 8, the average on time of the sample gating signal gradually increases since the number of pulses per unit of time increases until scale factor 8 is reached in which case the number of pulses per unit of time reaches a maximum. When SF4 switches to logic one, the subpulse A of relative width "a" modulated signal is combined with the subpulse B of relative width "b" modulated signal.

The result of this is shown in the lower half of FIG. 5. In the case of scale factor 9, one of the eight cycles shown for that case has a sample gating signal of relative width a+b (subpulse A and subpulse B) whereas the other 7 cycles have a relative width b (subpulse B only). Scale factor 10 causes two cycles of relative width a+b and six cycles of relative width B. This progression is carried through to scale factor 16 in which case all cycles have relative width a+b. It is understood that other combinations of sample period modulation and sample pulse width modulation are possible. The decay period in a system employing both parts of the present invention will function similarly to that described above except with a reverse modulation progression. The use of part two of the present invention independently from part one may be accomplished as described hereinafter. The sample gating signal from generator assignment logic 14 of FIG. 1 is applied to one input of AND gate 36 and OR gate 38 replacing the once modulated sample gating signal from AND gate 34 of FIG. 2 of part one of the present invention. With this substitution made, part two will function as described above. The apparatus shown in FIG. 3 will produce a two step attack and decay since there are only two logic states for SF4. However, based on the principle of subpulsing to control note amplitude as disclosed herein, it is possible to increase the number of note amplitude steps within the duration of the waveshape generator multiplex channel time slot. Employing subpulses of shorter time duration and available note attack and decay scale factors in combination with logic gating techniques known in the art, the principle of subpulse controlling of note amplitude disclosed in part two may be expanded according to instrument design.

The present two-part invention may be embodied in other specific forms without departing from the spirit or essential attributes thereof and, accordingly, reference should be made to the appended claims, rather than to the foregoing specification as indicating the scope of the invention.

I claim:

1. In an electronic musical instrument having plural multiplexed waveshape generator channels, a keyboard, a demultiplexing audio waveshape generator for generating an audio signal derived from said plural multiplexed waveshape generator channels, generator assignment logic operatively associated with said keyboard for generating a sample gating signal which indicates that one or more of said multiplexed channels have been captured by said keyboard, and a multiplexed attack and decay scale factor generator for generating scale factors for each multiplexed channel to produce a desired attack and decay envelope for each of said audio waveshape generator channels, the combination comprising:

a counter, a clock for repetitively advancing said counter through plural counts, a digital comparator for comparing each of said counts to said attack and decay scale factors, gating logic connected to said comparator for modulating said sample gating signal by transmitting said sample gating signal to a waveshape generator if a scale factor is greater than or equal to said count and by blocking said sample gating signal otherwise.

2. The combination of claim 1 wherein said counter is an eight state counter.

3. The combination of claim 2 wherein said eight state counter is a 3 state binary counter.

4. In an electronic musical instrument having plural multiplexed waveshape generator channels, a keyboard, a demultiplexing audio waveshape generator for generating an audio signal derived from said plural multiplexed waveshape generator channels, generator assignment logic operatively associated with said keyboard for generating a sample gating signal which indicates that one or more of said multiplexed channels have been captured by said keyboard, and a multiplexed attack and decay scale factor generator for generating scale factors for each multiplexed channel to produce a desired attack and decay envelope for each of said audio waveshape generator channels, each of said scale factors comprising plural bits, the combination comprising:

first means connected to said attack and decay scale factor generator for detecting at least one of said scale factor bits and for passing said sample gating signal when said one bit is in a first binary state and for blocking said sample gating signal when said ond bit is in a second binary state, said first and second binary states being complementary, second means connected to said attack and decay scale factor generator for detecting said one bit and for passing said sample gating signal when said one bit is in said second binary state, third means for generating a first subpulse, fourth means for generating a second subpulse, first means connected to said first means and said third means for transmitting said first subpulse when said first means passed said sample gating signal or when said first means blocks said sample gating signal, sixth means connected to said second means and said fourth means for transmitting said second subpulse only when said second means passes said sample gating signal, seventh means connected to said fifth and sixth means for transmitting said first and second subpulses transmitted to said fifth and sixth means to said audio waveshape generator.

5. In an electronic musical instrument having plural multiplexed waveshape generator channels, a keyboard, a demultiplexing audio waveshape generator for generating an audio signal derived from said plural multiplexed waveshape generator channels, generator assignment logic operatively associated with said keyboard for generating a sample gating signal which indicates that one or more of said multiplexed channels have been captured by said keyboard, and a multiplexed attack and decay scale factor generator for generating scale factors for each multiplexed channel to produce a desired attack and decay envelope for each of said audio waveshape generator channels, each of said scale factors comprising plural bits, the combination comprising:

a counter, a clock for repetitively advancing said counter through plural counts, a digital comparator for comparing each of said counts to said attack and decay scale factors, gating logic connected to said comparator for modulating said sample gating signal by transmitting said sample gating signal if a scale factor is greater than or equal to a count and by blocking said sample gating signal otherwise, first means connected to said attack and decay scale factor generator for detecting at least one of said scale factor bits and for passing said sample gating signal transmitted by said gating logic when said one bit is in a first binary state and for blocking said sample gating signal when said one bit is in a second binary state, said first and second binary states being complementary, second means connected to said attack and decay scale factor generator for detecting said one bit and for passing said sample gating signal transmitted by said gating logic when said one bit is in said second binary state, third means for generating a first subpulse, fourth means for generating a second subpulse, fifth means connected to said first means and said third means for transmitting said first subpulse when said first means passes said sample gating signal transmitted by said gating logic or when said first means blocks said sample gating signal, sixth means connected to said second means and said fourth means for transmitting said second subpulse only when said second means passes said sample gating signal transmitted by said gating logic, seventh means connected to said fifth and sixth means for transmitting said first and second subpulses transmitted by said fifth and sixth means to said audio waveshape generator.

* * * * *